US009263007B2

(12) United States Patent
Goble

(10) Patent No.: US 9,263,007 B2
(45) Date of Patent: Feb. 16, 2016

(54) GUITAR PICK

(71) Applicant: Grant H Goble, Pine, CO (US)

(72) Inventor: Grant H Goble, Pine, CO (US)

( * ) Notice: Subject to any disclaimer, the term of this patent is extended or adjusted under 35 U.S.C. 154(b) by 0 days.

(21) Appl. No.: 14/630,059

(22) Filed: Feb. 24, 2015

(65) Prior Publication Data

US 2015/0262562 A1 Sep. 17, 2015

Related U.S. Application Data

(60) Provisional application No. 61/954,274, filed on Mar. 17, 2015.

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS

| | | | | | |
|---|---|---|---|---|---|
| 401,476 | A * | 4/1889 | Barnes | G10D 3/163 | 84/322 |
| 566,806 | A * | 9/1896 | Shearer | G10D 3/163 | 273/129 R |
| 756,348 | A * | 4/1904 | Forney | G10D 3/163 | 273/129 R |
| 842,920 | A * | 2/1907 | Theodorf | G10D 3/163 | 84/322 |
| 1,444,982 | A * | 2/1923 | Orth | G10D 3/163 | 84/322 |
| 1,547,560 | A | 7/1925 | Burdwise | | |
| 2,481,759 | A * | 9/1949 | Lawrence | G10D 3/163 | 84/322 |
| 3,735,663 | A | 5/1973 | Cowell, Sr. | | |
| 3,789,720 | A | 2/1974 | McIntyre | | |
| 4,347,773 | A | 9/1982 | Zook | | |
| 4,691,609 | A * | 9/1987 | Acocella | G10D 3/163 | 84/322 |
| 4,843,942 | A * | 7/1989 | Ishizuka | G10D 3/163 | 84/322 |
| 5,341,715 | A | 8/1994 | Hucek | | |
| 5,509,341 | A | 4/1996 | Dunlop | | |
| 6,130,374 | A * | 10/2000 | Polidori | G10D 3/163 | 84/320 |
| 7,256,337 | B1 * | 8/2007 | Walker | G10D 3/163 | 84/258 |
| 7,462,768 | B2 | 12/2008 | Newmaster | | |
| D603,449 | S | 11/2009 | Whetstine | | |
| D603,891 | S | 11/2009 | Whetstine | | |
| 7,683,245 | B2 * | 3/2010 | Judd | G10D 3/163 | 84/320 |
| 7,718,874 | B2 | 5/2010 | Cheok | | |
| 7,786,362 | B1 | 8/2010 | Whetstine | | |
| 8,378,193 | B2 * | 2/2013 | Culver | G10D 3/163 | 84/320 |
| 8,664,498 | B2 * | 3/2014 | Leneman | G10D 3/163 | 84/322 |
| 2005/0211053 | A1 * | 9/2005 | Ball | G10D 3/163 | 84/322 |
| 2009/0217797 | A1 * | 9/2009 | Cheok | G10D 3/163 | 84/322 |
| 2015/0143973 | A1 * | 5/2015 | Caccia | G10D 3/163 | 84/322 |
| 2015/0262562 | A1 * | 9/2015 | Goble | G10D 3/163 | 84/322 |

* cited by examiner

*Primary Examiner* — Robert W Horn
(74) *Attorney, Agent, or Firm* — Leyendecker and Lemire, LLC

(57) ABSTRACT

A guitar pick is described that places the playing edge and associated tip at an angle relative to a planar body that is grasp by the thumb and forefinger of a player to permit the player to hold his/her wrist at a more natural angle when playing. The pick is characterized by an arcuate wall that rises from a distal end of the pick, which in combination with the body forms a cradle for the thumb. A planar jut extends from the top edge of the arcuate wall and includes the playing edge and tip of the pick. The plane defined by the jut and the plane defined by the body define an acute angle of intersection.

20 Claims, 11 Drawing Sheets

GUITAR PICK

RELATED APPLICATIONS

This application claims prior to and incorporates fully by reference U.S. Provisional Application #61954274 entitled Guitar Pick filed on Mar. 17, 2014 and having the same inventor as the present application.

BACKGROUND

Traditionally, guitar picks used to pluck the strings of a guitar are flat and generally teardrop shaped. The pick is held by a player between his/her thumb and index finger at the wide end wherein the strings are plucked with the tip at the thinner more pointed end.

Generally speaking, it is desirable to contact the strings of a guitar such that the plane of the pick is parallel to the direction of the string. To accomplish this, a player may need to bend his/her wrist unnaturally can cause wrist fatigue and may contribute to joint and connective tissue damage in the wrist over time.

Several different pick designs have been proposed through the years. Generally, these alternative pick designs maintain the elongated tear drop shape but twist and/or bend the pointed string-plucking tip such that a player can at least theoretically hold the pick more naturally. Interestingly, the twisted design forces many players to hold these picks farther back on the wide end increasing the distance from the players thumb and the plucking tip. Ostensibly for many players especially those who prefer to choke up on a pick, it is difficult to easily and quickly find a comfortable position to hold these picks.

DETAILED DESCRIPTION

Figure 1:
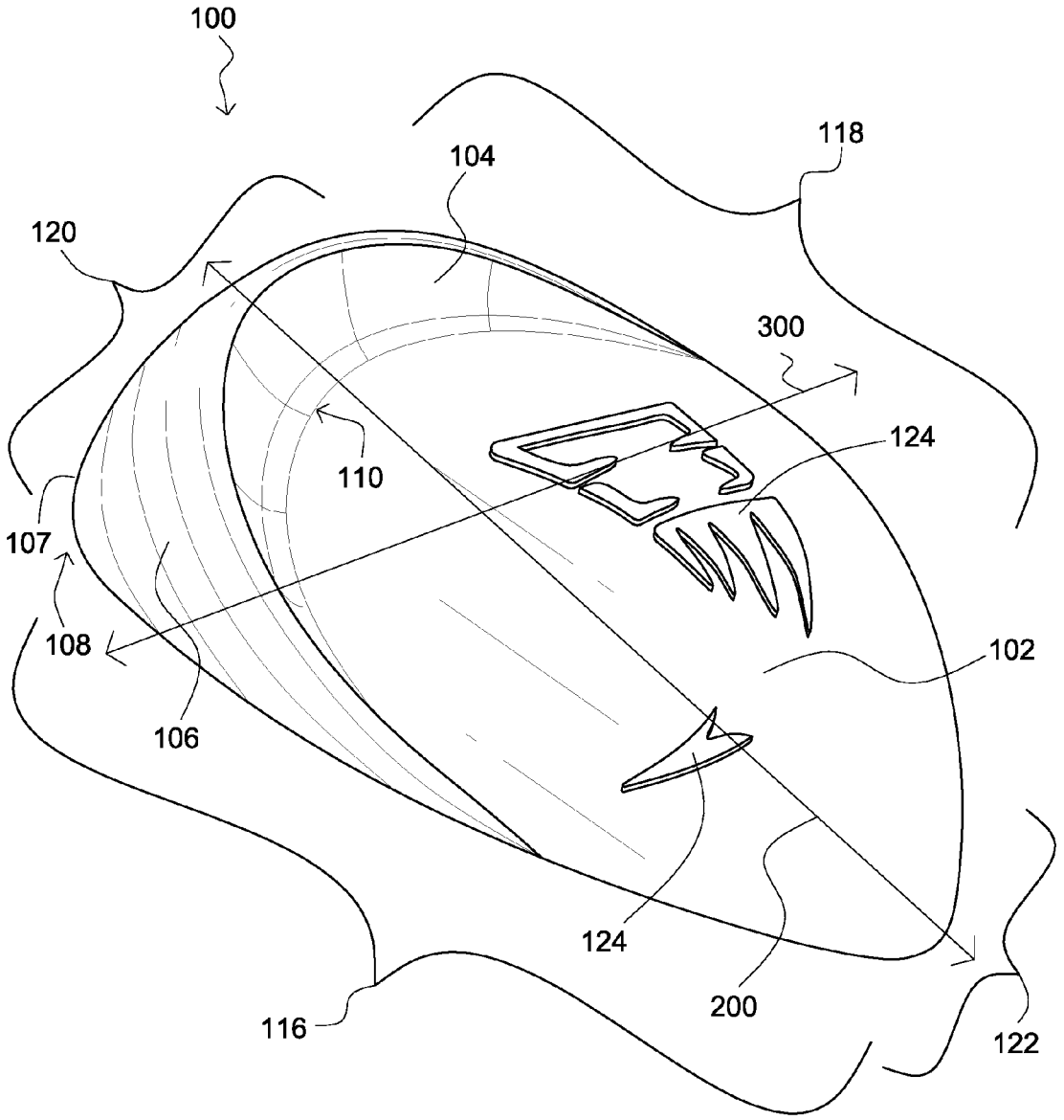
FIG. 1 is a perspective top left side view of the guitar pick according to an embodiment of the present invention.
Figure 2:
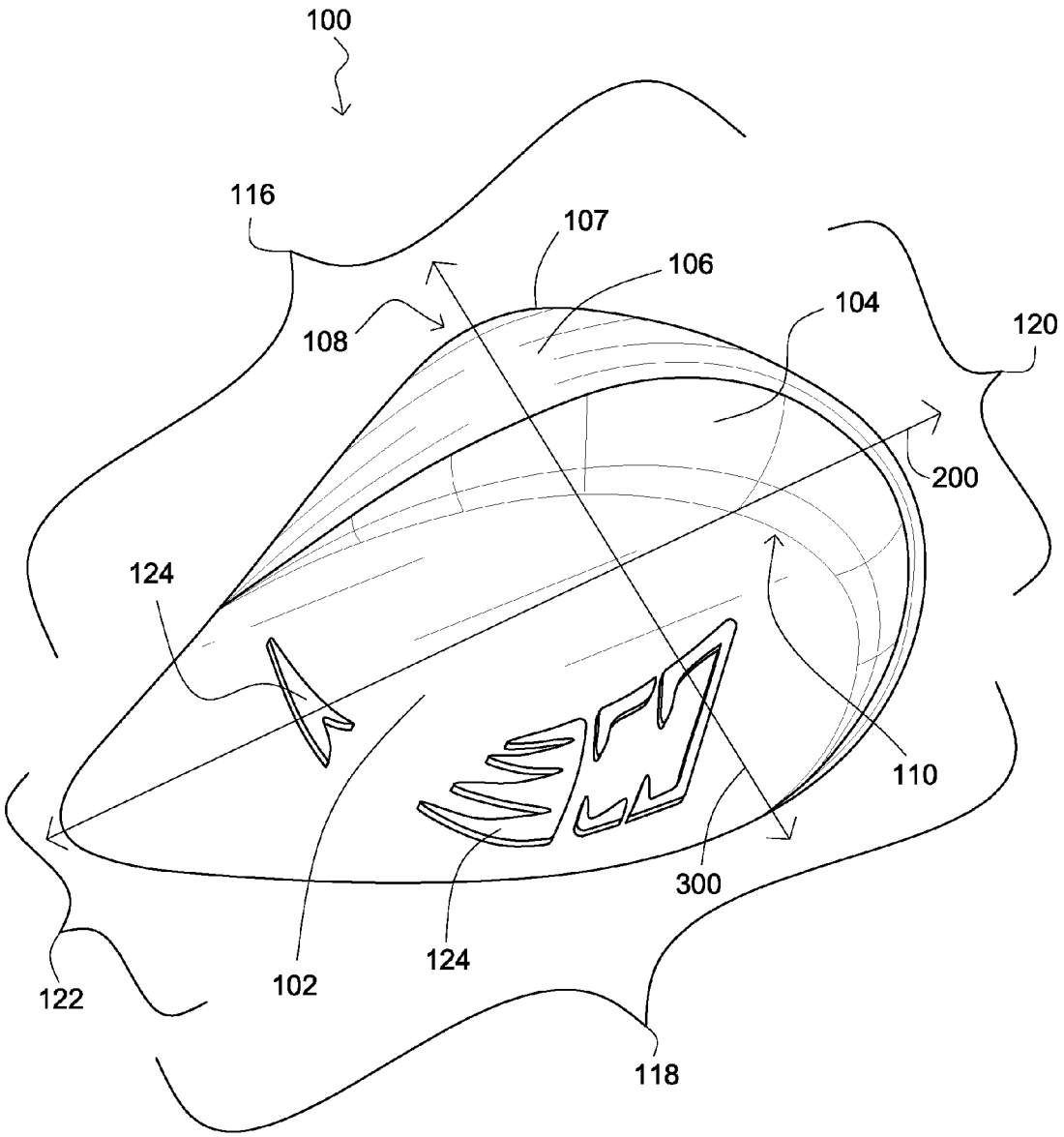
FIG. 2 is a perspective top right side view of the guitar pick according to the embodiment of the present invention.

Embodiments of the present invention comprise guitar picks that place the playing edge and associated tip of each at an angle relative to a planar body that is grasp by the thumb and forefinger of a player to permit the player to hold his/her wrist at a more natural angle when playing. In typical prior art picks the playing edge and tip are located at or proximate the end of a longitudinal axis thereof. In contrast in at least some of the embodiments of the present invention, the tips and playing edges are located at or proximate the end of a lateral axis of the pick.

In at least some embodiments, an arcuate wall (also referred to herein as a "riser wall") rises along the playing side of the pick's body and extends along a front (or top) side of the pick and forms an upper cradle that acts as a stop to properly position the player's thumb relative to the pick's top side and playing side (the left side for right handed players). A smaller downwardly projecting but similarly positioned arcuate ridge extends around a portion of the bottom side of the pick's body to form a stop or lower cradle for the player's index finger. The upper and lower cradles permit and facilitate a player to correctly find a comfortable pick holding position nearly instantaneously.

A planar jut extends outwardly from the top edge of the riser wall and terminates at the playing edge or tip. The top edge of the riser wall forms an angle with the plane of the body. The planer jut extends outwardly from the riser wall top edge generally normal to the riser wall. Consequently, the angle of the playing edge and tip correspond closely to the angle between the body and the top edge of the riser wall. Embodiments of the picks are offered with different body/playing edge angles to accommodate the proclivities of particular players. As can be appreciated picks with larger angles have riser walls that extend to greater heights than those with more slight angles.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, upper, lower, vertical, horizontal, back, front and lateral are relative to each other and are dependent on the specific orientation of an applicable element or article, and are used accordingly to aid in the description of the various embodiments and are not necessarily intended to be construed as limiting.

An Embodiment of a Guitar Pick

An embodiments of an improved guitar pick 100 is illustrated FIGS. 1-10 from a variety of different perspectives. In several of the figures for reference and as is practicable, the longitudinal and lateral axes 200 & 300 of the pick's planar body 102, and the upper, lower, left and right sides 120, 122, 116 & 118 of the pick are identified. The illustrated embodiment comprises a right hand pick intended to be held in a player's right hand. As such, the left side 116 is also the playing side of the pick that includes the planar jut 106 with the playing edge 107 and tip 108. As can be appreciated, left hand picks are contemplated for left-handed guitarists. The playing side of a left-handed pick would comprise the right side thereof.

The illustrated embodiment pick is typically fabricated in a single piece. The pick is typically comprised of a suitable plastic material although it can be made of other materials as well. The picks can be fabricated by any suitable means including machining, stereo lithography and 3D printing; however, injection molding of the picks particularly in quantity is typically the most cost effective means of fabrication. Although the size of pick embodiments can vary significantly a typical pick is about 1 3/16" long, 1" wide, and 0.020-0.050" thick depending on where the measurement is taken.

The pick includes a planar body portion 102 that has a generally tear drop shape, which is generally reminiscent of a typical flat prior art guitar pick; however, the more pointed end of the pick faces towards a player's hand in use unlike the prior art pick in which the pointed end comprises the playing tip. In the illustrated embodiment the pointed end comprises part of the pick's lower side 122. The opposing rounded end of the body portion comprises part of the upper side 120 of the pick. The left and right sides 116 & 118 of the pick bound the left and right edges of the body portion and extend between the upper and lower sides. As applicable in some of the Figures, longitudinal and lateral axes 200 & 300 are defined and illustrated. The longitudinal axis 200 extends from a proximate midpoint of the body portion's lower side to the approximate midpoint of the body portion's upper side. The length of the body along this axis is typically the longest distance between the edges of the respective upper and bottom sides. Although this length can vary across embodiments, a typical length is about 1 3/16". The lateral axis is generally normal to the longitudinal axis and typically extends across the widest part of the body between the left and right sides. Although the width can vary across embodiments, a typical length is about 0.8-1.0".

The body portion 102 serves as the instrumentality by which a player grips the pick cradling it between the thumb on a top surface and the index finger on the opposing bottom surface. The shape of the planar body portion can vary in other embodiments. For instance, the lower side 122 of the pick and the body portion need not be pointed. The thickness of the body portion can vary across embodiments depending in part on the material from which the pick is constructed; however, in a typical pick the thickness is about 0.025-0.03". As can be appreciated, variations are contemplated where the body portion is not wholly planar.

In some embodiments, such as illustrated, a raised logo 124 or other raised indicia can be molded on the surface or surfaces of the body. The raised logo or indicia rises above the surface of the body only several thousandths of an inch (about 0.010" in a typical embodiment), but can provide a tactile surface that helps the player better grip the pick. While no indicia are shown on the bottom surface in the illustrated embodiments, variations that include raised indicia on this surface are also known. Furthermore, in place of or in addition to indicia, the surfaces of the body portion can be textured or patterned to provide tactility.

Starting at a location along the left edge of the left side 116 of the body portion 102 closer to the lower side 122 than the upper side 120, a wall 104 (herein referred to as the "riser wall" or "arcuate wall") rises generally perpendicularly relative to the planar body 102. The riser wall extends towards and around the arcuate edge of the upper side 120 typically terminating before reaching the intersection of the right side edge with the lateral axis 300. The inwardly facing intersection 110 between the riser wall and the body portion 102 is radiused.

Figure 7:
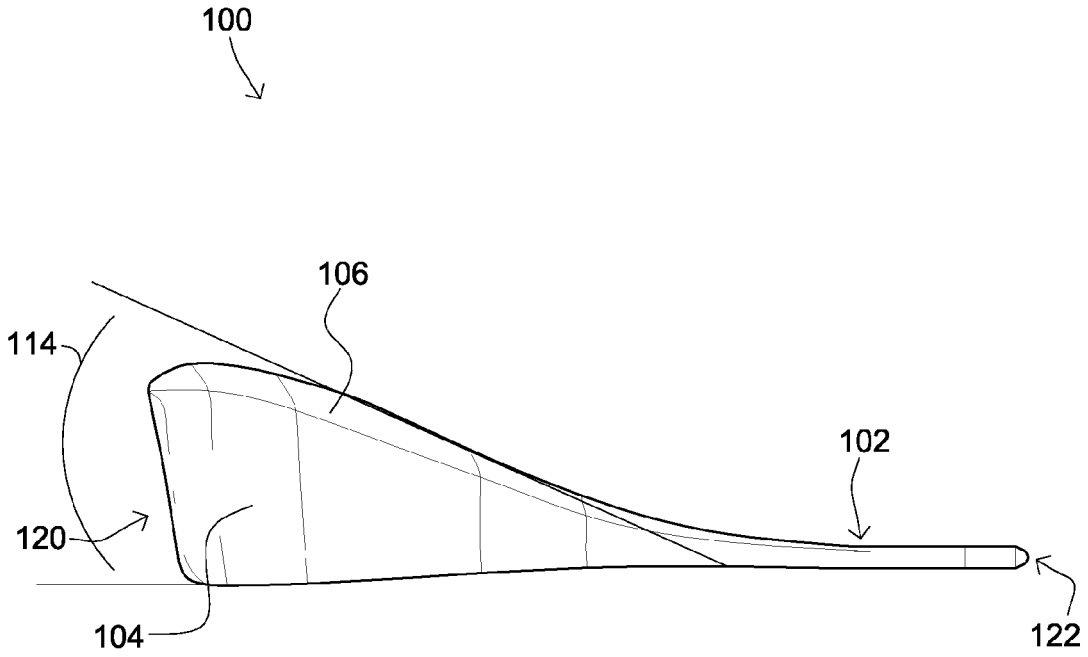
FIG. 7 is a left side view of the guitar pick according to the embodiment of the present invention.
Figure 8:
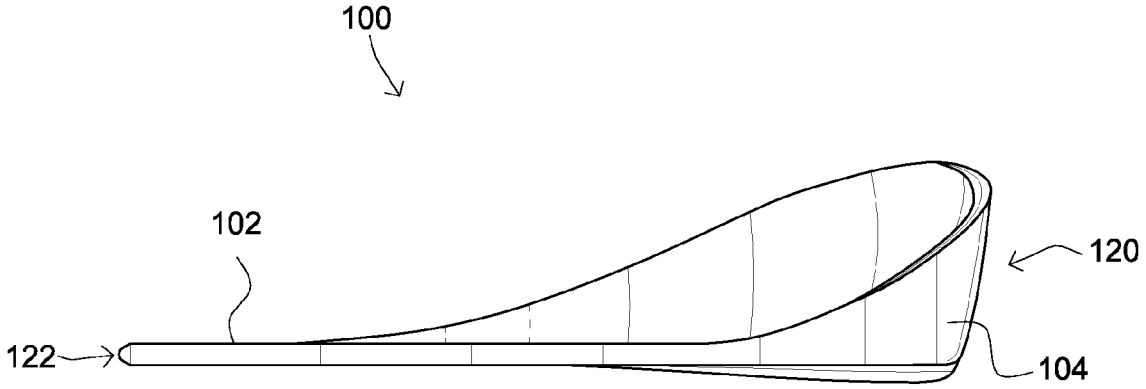
FIG. 8 is a right side view of the guitar pick according to the embodiment of the present invention.
Figure 9:
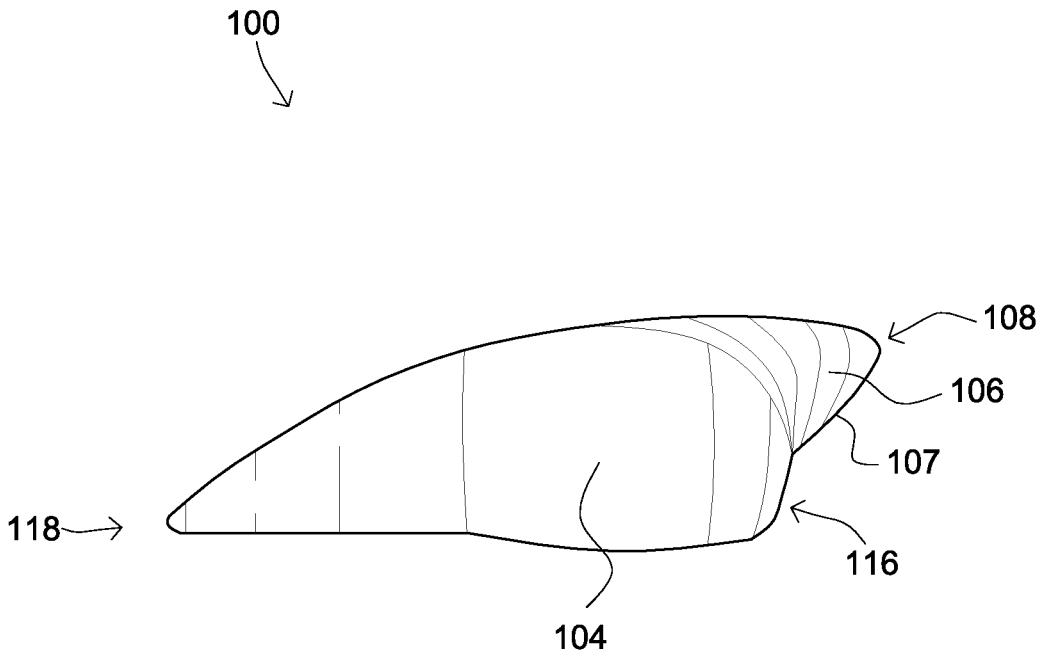
FIG. 9 is a front view of the guitar pick according to the embodiment of the present invention.
Figure 10:
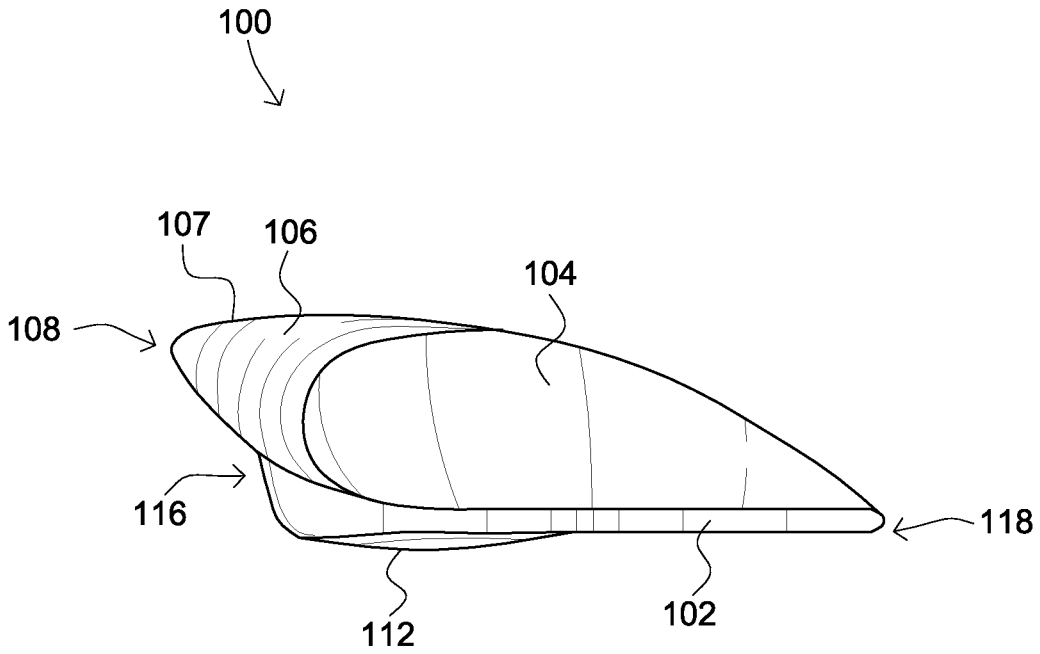
FIG. 10 is a back end view of the guitar pick according to the embodiment of the present invention.

Of great significance, the top edge of the wall 104 extends upwardly from the wall's genesis on the left side 116 at a predetermined angle 114 as best seen in FIG. 7. The edge continues to rise upwardly along the wall until reaching maximum height above the planar body 102 at a location on the edge proximate but before (or to the left of) the intersection of the riser wall with the longitudinal axis 200. After reaching its height apex the riser wall edges levels out and then declines until interfacing with the terminus of the riser wall on the right side. As can be appreciated the height of riser wall differs for different variations of the pick having different predetermined angles; however, in typical embodiments of various angles the heights vary from about 0.1-0.3". As is described in detail below, the predetermined angle defines in at least a significant part the angle of the playing edge 107 and playing tip 108 relative to the planar body.

On the left side 118 from the top edge of the riser wall 104 a planar jut 106 extends generally perpendicularly outwardly therefrom. The edges of the jut form a radiused playing tip 108 with the portion of the jut's edge on either side of the tip comprising the playing edge 107. The playing tip and edge along with much of the planar jut itself are the portions of the pick that make direct contact with the strings of a guitar when the pick is being used in the playing of the guitar. Of significant note, the planar jut and its associated playing edge and tip are located on generally the left side of the pick.

Figure 11:
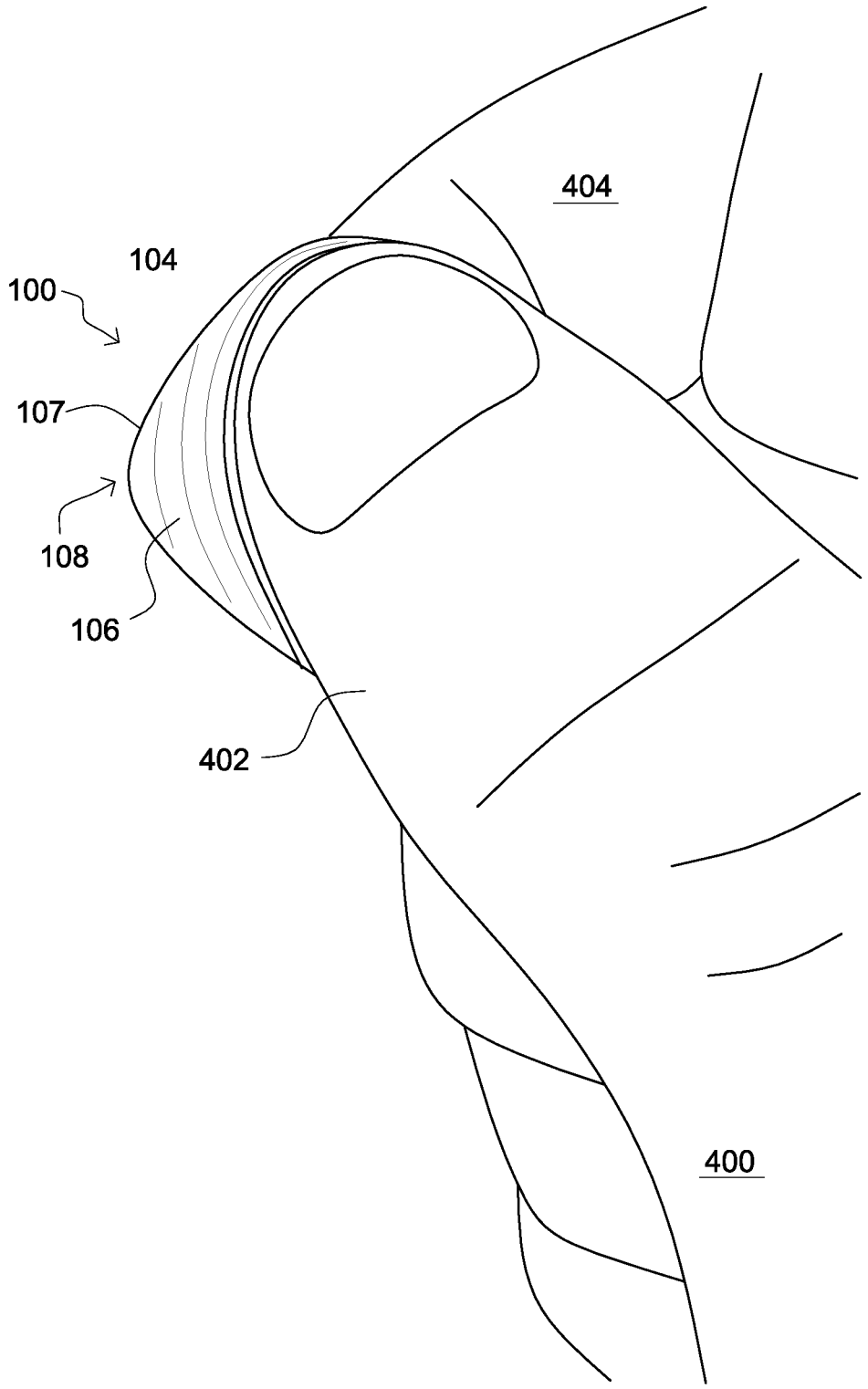
FIG. 11 is an isometric view showing an embodiment of the pick being held in the hand of player.

With reference to FIG. 11, a player's thumb 402 is typically orientated such that its longitudinal axis is generally parallel to the longitudinal axis 200 of the pick such that the playing edge and playing tip are located adjacent the left side of the thumb. The effective angle of the playing edge relative to the planar body and consequently the face of the thumb when the pick is being held is determined by the combination of the predetermined angle 114 and the angle at which the planar jut 106 extends outwardly from the top edge of the riser wall 104. In the illustrated embodiment, the planar jut extends from the at a right angle so the effective angle of the playing edge to the planar body and user's thumb is determined exclusively by the predetermined angle. It is appreciated that in variations, the angle at which the jut extends from the riser wall can be either greater or lesser than 90 degrees and for these picks this angle will in combination with the predetermined angle determine the effective angle.

Embodiments of the pick can be produced in any number of desirable angles wherein the player can pick a pick that places the playing edge and the planar jut generally parallel to the strings of a guitar without the player having to unnaturally contort his/her wrist. Some of the typical angles include 8.5, 12.0, 15.5 and 19.0 degrees.

Figure 3:
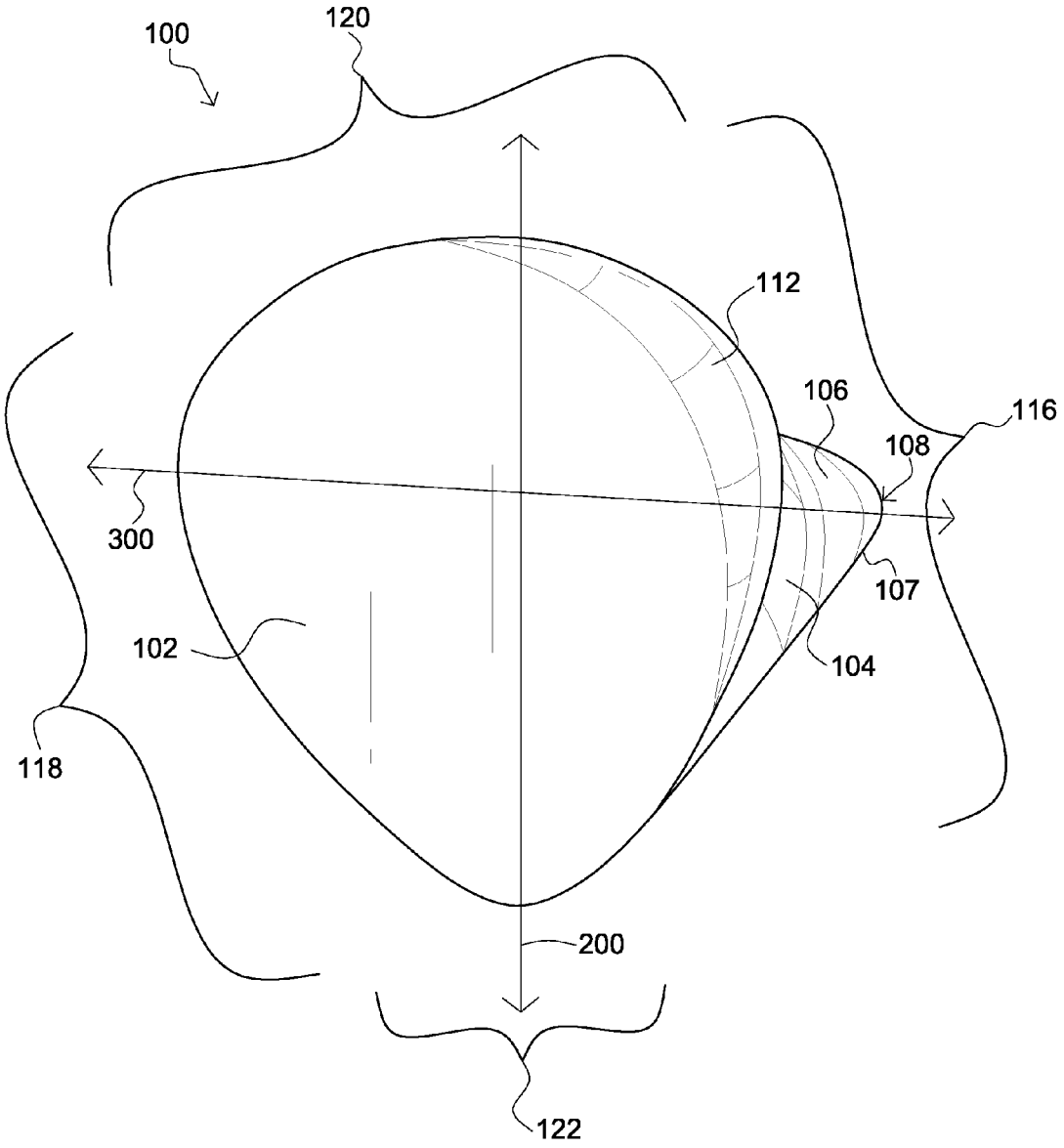
FIG. 3 is a perspective bottom back end view of the guitar pick according to the embodiment of the present invention.
Figure 4:
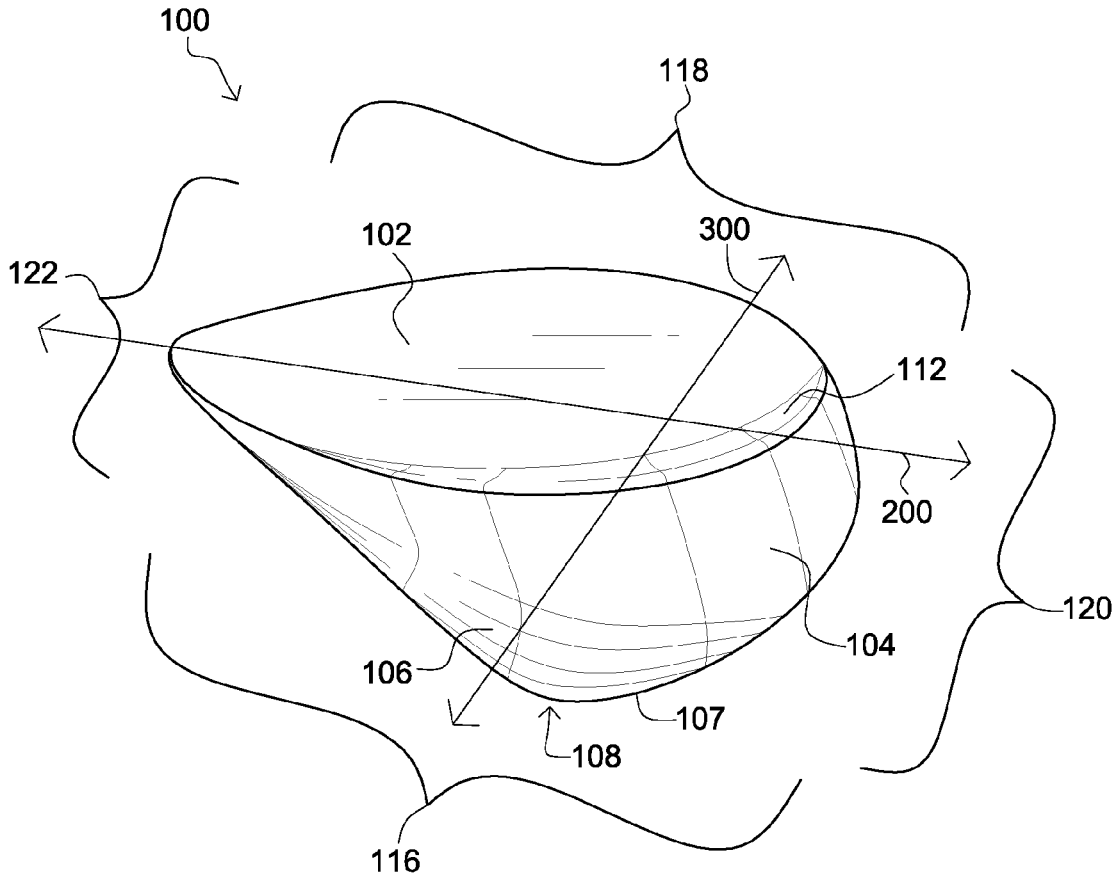
FIG. 4 is a perspective bottom left side view of the guitar pick according to the embodiment of the present invention.
Figure 5:
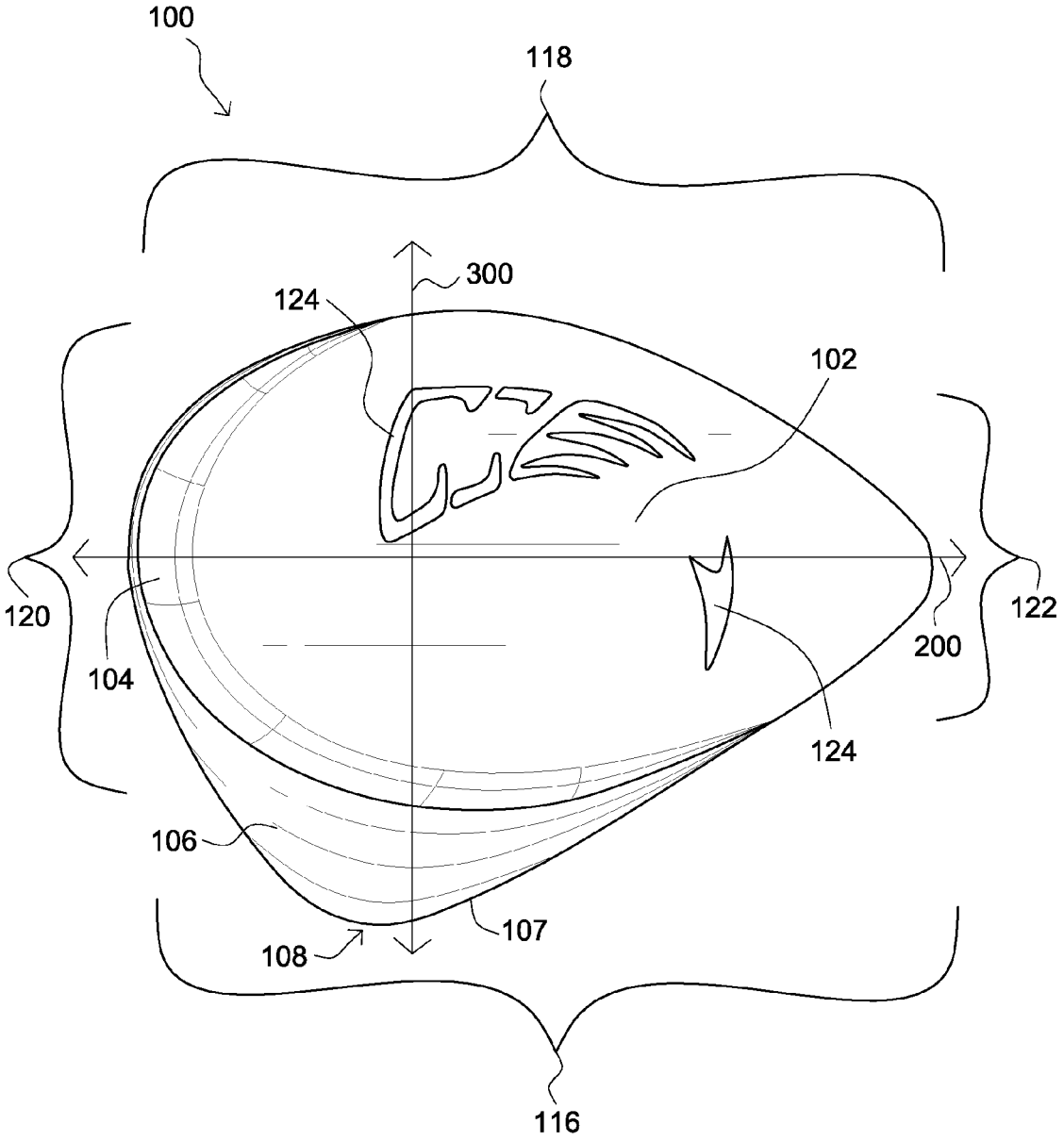
FIG. 5 is a top view of the guitar pick according to the embodiment of the present invention.
Figure 6:
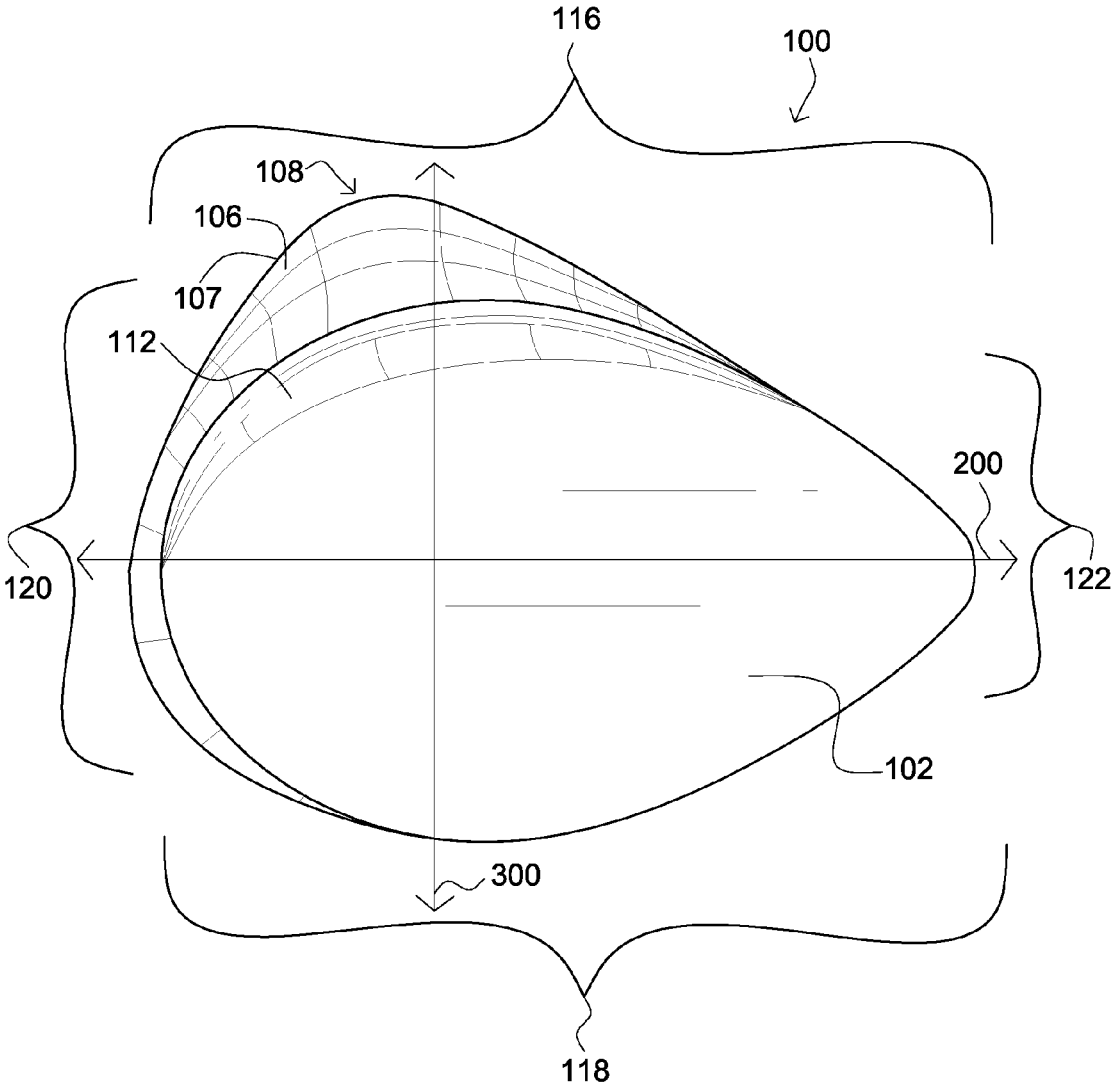
FIG. 6 is a bottom view of the guitar pick according to the embodiment of the present invention.

Referring specifically to FIGS. 3, 4 & 5, the bottom side of the pick and more specifically the bottom side of the planar body 102 is shown. Of significance is an arcuate ridge 112 that extends downwardly from the edge of the planar body along a section of the edge generally below the location where the planar jut 104 extends from the riser wall 104. The ridge serves at least two purposes: to serve as a stop for the index finger, which may rest up against the ridge depending on how a player holds the pick in use; and as a reference location alerting a player as to the position of his index finger on the pick so he/she can easily and quickly without much thought adjust his/her finger into the proper position. The height of the ridge off of the bottom surface of the planar body can vary but it is typically slight in comparison to the opposing riser wall 104. In a typical pick, the arcuate ridge has a downwardly-extending height of about 0.040"-0.10".

A Method of Playing a Guitar Using an Embodiment of the Pick

Prior to using an embodiment of the pick 100 to play a guitar, the player chooses a pick having a desirable effective angle between the planar body 102 and the playing edge 107. Ideally, with the guitar positioned on the player as it is normally worn or held, the player chooses a pick having an angle that permits him/her to hold the pick naturally without contorting his/her wrist to bring the playing edge effectively parallel to the strings. Embodiments of the pick are made in a variety of effective angles.

To play the guitar with the pick having a desired effective angle, the player picks up the pick with his/her playing hand 400 placing the thumb 402 on the top surface of the body portion 102 cradling the top and left side of his/her thumb against the riser wall 104. As typically orientated, the longitudinal axis of the thumb is generally parallel with the longitudinal axis 200 of the pick. The index finger 404 is placed on the bottom surface of the body portion. The index finger is generally orientated at about a 90 degree angle relative to the thumb with the front of the finger more directly facing in the direction of the playing edge 107. Depending on the personal proclivities of the player, he/she might place the front of his index finger against the arcuate ridge 112 with the ridge acting as a stop and a cradle for the index finger. FIG. 11 illustrates a pick being held in a right hand.

When playing the guitar, the pick is ideally held so that the playing edge 107 is parallel with the strings. The player than plays the guitar in whatever style he/she desires.

Variations and Other Embodiments

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention. For instance, versions of the pick configured for left-handed players are contemplated that share all the pertinent features of the right-handed embodiment except the playing edge, playing tip and associated structure is located on the right side of the planar body instead of the left side.

I claim:

1. A pick for a musical instrument having strings, comprising:

a body having a left, right, upper and lower edges, the upper edge and at least part of the left edge being arcuate;

an arcuate wall extending upwardly from the left and upper edges at a first angle, the arcuate wall having a top edge, the top edge forming an acute predetermined angle relative to the left edge;

a jut extending outwardly from the top edge at a second angle, the jut including an outer edge, the outer edge including a tip.

2. The pick of claim 1, wherein the body is substantially planar.

3. The pick of claim 1, wherein a top surface of the body includes raised indicia provided thereon.

4. The pick of claim 1, wherein the predetermined angle is between 10 degrees and 45 degrees.

5. The pick of claim 1, wherein the intersection of the arcuate wall and the body is radiused.

6. The pick of claim 1, wherein the first angle is about 90 degrees.

7. The pick of claim 1, wherein the top edge intersects with the left edge.

8. The pick of claim 1, wherein the jut is substantially planar.

9. The pick of claim 1, wherein the second angle is about 90 degrees.

10. The pick of claim 1, wherein the body is about 0.020-0.050" thick.

11. The pick of claim 1, wherein the tip is located adjacent the left side.

12. The pick of claim 1, wherein the pick is injection molded.

13. The pick of claim 1, further including an arcuate ridge extending downwardly from at least part of the left edge.

14. The pick of claim 13, wherein the arcuate ridge is about 0.040-0.10" in height.

15. The pick of claim 13, wherein the arcuate ridge is located directly below a portion of the arcuate wall wherein the jut extends outwardly.

16. A pick for a musical instrument having strings, comprising:

a substantially planar body having a left, right, upper and lower edges, the upper edge and at least part of the left edge being arcuate;

an arcuate wall extending upwardly from the left and upper edges at a first angle, the arcuate wall having a top edge, the top edge forming an acute predetermined angle relative to the left edge;

a substantially planar jut extending outwardly from the top edge at a second angle, the jut including an outer edge, the outer edge including a tip; and an arcuate ridge extending downwardly from at least part of the left edge at a location directly below a portion of the arcuate wall wherein the jut extends outwardly.

17. The pick of claim 16, wherein the first and second angles are about 90 degrees.

18. The pick of claim 17, wherein a top surface of the body includes raised indicia provided thereon.

19. A pick for a musical instrument having strings, comprising:

a body having a left, right, upper and lower edges, the upper edge and at least part of the left edge being arcuate;

an arcuate wall extending upwardly from one of the left and right edges and the upper edge at a first angle, the arcuate wall having a top edge, the top edge forming an acute predetermined angle relative to the one of the left and right edges;

a jut extending outwardly from the top edge at a second angle, the jut including an outer edge, the outer edge including a tip.

20. The pick of claim 19, wherein the one of the left and right edges is the left edge.

* * * * *